United States Patent [19]

Ritter et al.

[11] Patent Number: 4,797,964

[45] Date of Patent: Jan. 17, 1989

[54] COMPOSITIONS FOR FINISHING TEXTILES

[75] Inventors: Wolfgang Ritter, Hilden; Hans-Peter Handwerk, Duesseldorf; Kaspar Schlueter, Solingen; Heinz Hassenjuergen, Korschenbroich, all of Fed. Rep. of Germany

[73] Assignee: Henkel Kommanditgesellschaft auf Aktien, Duesseldorf, Fed. Rep. of Germany

[21] Appl. No.: 65,232

[22] Filed: Jun. 22, 1987

[30] Foreign Application Priority Data

Jun. 20, 1986 [DE] Fed. Rep. of Germany ..... 3620679

[51] Int. Cl.[4] ..... D06M 15/00

[52] U.S. Cl. ..... 8/115.6; 524/832; 524/755; 252/8.6; 427/392

[58] Field of Search ..... 524/832, 755; 8/115.6; 428/248; 252/8.6

[56] References Cited

U.S. PATENT DOCUMENTS 4,477,623 10/1984 Pons et al. ..... 524/832

*Primary Examiner*—Paul Lieberman
*Assistant Examiner*—John F. McNally
*Attorney, Agent, or Firm*—Ernest G. Szoke; Henry E. Millson, Jr.; Wayne C. Jaeschke

[57] ABSTRACT

Preparations for finishing textiles, more especially sheet-form textiles, based on emulsion polymers of vinyl acetate and/or copolymers thereof with dibutyl maleate containing protective colloids in addition to small quantities of standard auxiliaries, wherein the polymer emulsions contain as a protective colloid polyethylene glycol having an average molecular weight of from about 3000 to 50,000 which was at least partly present during the original emulsion polymerization.

13 Claims, No Drawings

COMPOSITIONS FOR FINISHING TEXTILES

BACKGROUND OF THE INVENTION

1. Field of the Invention

The present invention relates to preparations for finishing textiles, particularly sheet-form textiles.

2. Statement of Related Art

It is known that sheet-form textiles can be finished by the application of aqueous emulsion polymers to the textile material to be finished. These auxiliaries applied in the course of finishing serve, inter alia, as filling agents, as stiffening agents, as non-slip agents, as weighting agents, as agents for improving seam tear resistance, as antisnagging agents, and the like. The plastic dispersions or emulsions used are, in particular, products based on vinyl acetate, dibutyl maleate, vinyl propionate, and acrylates. These products are also used to vary feel; polyvinyl acetate dispersions giving a very hard, stiff feel. Although feel can be improved by using plasticizers, this technical solution is seriously limited. The plasticizers are at least partly volatile at the temperatures used in various stages of the finishing process, so that the textile material undergoes an undesirable change in feel. Dibutylphthalate is one example of a platicizer of this type.

It is known that the deficiencies of vinyl acetate homopolymers plasticized in this way can be overcome by using copolymers of vinyl acetate with dibutyl maleate (DBM). Polyvinyl propionates used as finishing agents also give a softer and fuller feel than vinyl acetate homopolymers. Particularly full and soft feels are obtained where polyacrylate emulsions or dispersions are used. For economic reasons, however, it is desirable to use as large a quantity as possible of vinyl acetate or homopolymers and/or copolymers therof. As a particularly inexpensive component by comparison with all other potentially suitable monomers, vinyl acetate is rated particularly highly for the formation of the textile finishing preparation.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to improve the known emulsion homopolymers and/or copolymers based on vinyl acetate and copolymers thereof with dibutyl maleate (DBM) to such an extent that, when used as textile finishing preparations, they have considerable advantages over comparable homopolymers or copolymers of the hitherto known type. They are intended in particular to give the textile a softer and fuller feel than hitherto known corresponding emulsion polymers based on vinyl acetate or copolymers thereof with DBM.

The invention is based on the surprising discovery that the choice of a specific protective colloid for emulsion polymers of the above type leads to the desired effects of increased fullness and greater softness in the feel testing of the resulting finished textiles.

Accordingly, the present invention relates to preparations for finishing textiles, more especially sheet-form textiles, based on emulsion polymers of vinyl acetate and/or copolymers thereof with DBM containing protective colloids in addition to small quantitive of standard auxiliaries, the new preparations containing as protective colloid in the polymer emulsions polyethylene glycol having an average molecular weight of from 3000 to 50,000, and which was at least partly present during the original emulsion polymerization process. The polyethylene glycol is preferably used in its entirety as a protective colloid during the original emulsion polymerization of copolymerization process.

Through the use of the above polyethylene glycol as a protective colloid, it is possible to produce polyvinyl acetate homopolymers and copolymers which, in the field of application of textile finishing preparations, are distinguished by a distinctly softer feel of the treated textile than where the usual protective colloids, for example polyvinyl alcohol and/or cellulose derivatives, are used. Another considerable advantage is that the dispersions used in accordance with the invention have a very high shear stability which benefits the processing of the dispersions in important steps of the textile finishing process. Through the optimization of those parameters of the preparations according to the invention which affect softness and feel, more especially the dibutyl maleate content and the quantity and type of protective colloid selected, within the framework indicated, it is possible to obtain products which, when applied to textiles, the superior to polyvinyl propionate dispersion with respect to the softness of the resulting feel. At the same time, however, these products satisfy all other requirements, particularly in regard to solids content, viscosity, dilutability, friction resistance and film quality. The possibilities for use of the present particularly inexpensive textile finish are thus considerably broadened.

The polyethylene glycols used as protective colloids are preferably present in a quantity of from 2 to 10% by weight, based on the total weight of the preparation. The content of vinyl acetate polymer or copolymer in the aqueous polymer emulsion is preferably from 40 to 60% by weight. Where copolymers of vinyl acetate with DBM are used, the DBM content may be up to 50 mole %, based on the sum of vinyl acetate and DBM, DBM contents of from about 5 to 45 mole % being particularly preferred. In general, the softness and fullness of the textile feel is greater or higher, the higher the DBM content of the copolymer.

The aqueous polymer dispersions of the invention also contain the usual auxiliaries in small quantities, including in particular emulsifiers, buffers, initiators for the polymerization reaction and/or salts. The emulsion polymers preferably contain no more than 5% by weight of these standard auxiliaries, and preferably from 0.5 to 3% by weight of emulsifiers. Suitable standard emulsifiers are, especially those based on nonionic surfactants, more especially polyethylene oxide adducts with hydrocarbon compounds containing a reactive hydrogen atom: preferred emulsifiers being alkylphenol-EO adducts. One example of a nonionic surfactant which makes a particularly suitable emulsifier is nonylphenol $\times$ 10 EO. However, other nonionic surfactants with a modified EO chain are also suitable. Particularly appropriate quantities for the nonionic surfactant are from 0.5 to 2% by weight. Particularly suitable quantities for the polyethylene glycol present as protective colloid are from 3 to 10% by weight, polyethylene glycols having an average molecular weight of from 8000 to 25,000 being particularly suitable.

The preparation of a number of vinyl acetate homopolymers and copolymers used in accordance with the invention is first described in the following Examples which show important production parameters for these polymer emulsions. The emulsions according to the invention are then compared with 4 comparison emulsions which have been prepared in the absence of polyethylene glycol as protective colloid. In each case, the assessment of shear stability, as determined by roller application using the padding process, is shown in the description of the product. Shear stability is assessed as follows:

The dispersions are applied to a fabric by means of a laboratory padder. To this end, the dispersions are introduced undiluted into the trough of a padding machine, the lower roller dips into the dispersion, and the contact pressure of the upper roller is adjusted to 10 kp/cm. The shear stability of the dispersion is observed over a period of 30 minutes at a speed of 30 m/minute. If, after 30 minutes, there are no deposits to be seen on the upper roller and the lower roller shows a uniform film without any breaks, the friction resistance is assessed as very good. If no changes occur in the first 10 minutes, the mark "good" is awarded. If deposits are to be seen on the upper roller or breaks in the film on the lower roller within the first 6 seconds, the product is assessed as poor.

The invention will be illustrated but not limited by the following examples.

EXAMPLES

A. Process for preparing the emulsion polymers or copolymers

(a) Preparation on a laboratory scale

The apparatus used was a 2 liter capacity face-ground glass apparatus equipped with a metal anchor stirrer, an intensive cooler and metering vessels. Most of the water was introduced into the reaction vessel and the sodium carbonate, the emulsifier, the foam inhibitor—if any—and the protective colloid were dissolved therein over a period of 2 hours at 80° to 85° C. The monomers were introduced into a 0.5 liter metering funnel. To prepare the initiator solution, potassium persulfate was dissolved in cold water. The solution was introduced into another metering funnel.

To carry out polymerization, monomer and initiator solution were simultaneously introduced into the reaction vessel at 82° to 88° C. The monomer and initiator solution were added as shown in Table 1 below:

TABLE 1

| Time (mins.) | Initiator solution added (ml) | Monomer added (ml) |
|---|---|---|
| 0 | 0 | 0 |
| 20 | 20 | 52 |
| 40 | 20 | 100 |
| 60 | 35 | 170 |
| 120 | 50 | 300 |
| 180 | 65 | 425 |
| 240 | 75 | 525 |

The reaction was carried out with stirring (140 r.p.m.). The reaction temperature was kept between 80° and 88° C. In the event of excessive reflux, the addition of monomer was temporarily reduced. After addition of the monomer, the rest of the initiator solution was rapidly added. When the reflux had finished, the after-reaction took place over a period of 30 minutes at 85° to 95° C.

(b) Preparation of dispersions on a 120 kg scale

The apparatus used was a 200 liter enamel apparatus with a capacity of 120 kg, an infinitely variable impeller stirrer, a 20 liter metering vessel and an ascending reflux condenser. The stirrer was adjusted to a speed of 140–200 r.p.m. After each batch, the apparatus was rinsed with water and then acetone and dried.

Procedure

Most of the aqueous phase was introduced into the reactor and sodium bicarbonate, emulsifier, foam inhibitor and protective colloid were dissolved therein over a period of 2 hours at 75° C. (preliminary solution). The intended quantity of monomer or the mixture of monomers was introduced into the metering vessel.

The initiator (potassium persulfate) was dissolved in the remaining water and the solution introduced into another metering vessel.

To carry out the polymerization, monomer and initiator solution were simultaneously introduced into the reactor at 82° to 88° C. at the rates shown in the following Table.

TABLE 2

| Time (mins.) | Initiator solution added (1) | Monomer added (1) |
|---|---|---|
| 0 | 0 | 0 |
| 20 | 1.86 | 6.3 |
| 40 | 1.86 | 6.3 |
| 60 | 3.46 | 20.6 |
| 120 | 5.06 | 34.8 |
| 180 | 6.66 | 49.1 |
| 240 | 8.26 | 63.0 |
| 260 | 9.30 | 63.0 |

The reaction temperature was kept between 80° and 88° C. In the event of excessive reflux, the addition of monomer was reduced. After addition of the monomer, the temperature was increased to 85° to 95° C. for the after-reaction. The dispersions could be packed after cooling to about 35° C.

EXAMPLE 1

| Raw material type | Raw material | Concentration % by weight | Concentration Kg |
|---|---|---|---|
| Water | | 36.5 | 43.8000 |
| Emulsifier | Nonylphenol-10 EO | 1.0 | 1.200 |
| Buffer | $NaHCO_3$ | 0.2 | 0.240 |
| Protective colloids | PEG 12000 | 3.0 | 3.600 |
| Monomers | Vinyl acetate | 18.55 | 22.260 |
| | Dibutyl maleate | 33.00 | 39.600 |
| Initiator solution | Potassium persulate | 0.25 | 0.300 |
| | Water | 7.50 | 9.000 |

| | |
|---|---|
| Viscosity: (Brookfield RVT 20° C./20 r.p.m.) | 20,000 mPa.s |
| Appearance: (film/glass) | clear, very few specks |
| Flexibility: | elastic, tack |
| Film/water behavior: | resistant |
| Particle size: | |
| Solids content: | 55.8% |
| Dispersion adjusted to 53% solids: | |
| Viscosity: (Brookfield RVT 20° C./20 r.p.m.) | 5,100 mPa.s |
| Solids content: | 52.8% |

-continued

| | |
|---|---|
| Shear stability: | very good |

EXAMPLE 2

| Raw material type | Raw material | Concentration % by weight | Concentration Kg |
|---|---|---|---|
| Water | | 36.5 | 0.365 |
| Emulsifier | Nonylphenol-10 EO | 0.5 | 0.005 |
| Buffer | $NaHCO_3$ | 0.2 | 0.002 |
| Protective colloid | PEG 12000 | 3.0 | 0.030 |
| Monomer | Vinyl acetate | 18.72 | 0.1872 |
| | Dibutyl maleate | 33.31 | 0.3331 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 3,000 mPa.s |
| Appearance: (film/glass) | clear, some specks |
| Flexibility: | elastic, tack |
| Film/water behavior: | resistant |
| Particle size: | 430 nm |
| Solids content: | 55.6% |
| Shear stability: | good |

EXAMPLE 3

| Raw material type | Raw material | Concentration % by weight | Concentration Kg |
|---|---|---|---|
| Water | | 36.5 | 0.365 |
| Emulsifier | Nonylphenol-10 EO | 0.5 | 0.005 |
| Buffer | $NaHCO_3$ | 0.2 | 0.002 |
| Protective colloid | PEG 12000 | 3.5 | 0.035 |
| Monomer | Vinyl acetate | 18.56 | 0.1856 |
| | Dibutyl maleate | 32.99 | 0.3299 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 9,600 mPa.s |
| Appearance: (film/glass) | clear, some specks |
| Flexibility: | elastic, tack |
| Film/water behavior: | resistant |
| Particle size: | 480 nm |
| Solids content: | 55.2% |
| Shear stability: | good |

EXAMPLE 4

| Raw material type | Raw material | Concentration % by weight | Concentration Kg |
|---|---|---|---|
| Water | | 36.5 | 0.365 |
| Emulsifier | Nonylphenol-10 EO | 0.5 | 0.005 |
| Buffer | $NaHCO_3$ | 0.2 | 0.002 |
| Protective colloid | PEG 12000 | 4.0 | 0.040 |
| Monomer | Vinyl acetate | 18.38 | 0.1838 |
| | Dibutyl maleate | 32.67 | 0.3267 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 23,500 mPa.s |
| Appearance: (film/glass) | clear, some specks |
| Flexibility: | elastic, tack |
| Film/water behavior: | resistant |
| Particle size: | 350 mm |
| Solids content: | 55.4% |
| Shear stability: | good |

EXAMPLE 5

| Raw material type | Raw material | Concentration % by weight | Concentration Kg |
|---|---|---|---|
| Water | | 36.5 | 0.365 |
| Emulsifier | Nonylphenol-10 EO | 1.0 | 0.010 |
| Buffer | $NaHCO_3$ | 0.2 | 0.002 |
| Protective colloid | PEG 12000 | 3.5 | 0.035 |
| Monomer | Vinyl acetate | 18.38 | 0.1838 |
| | Dibutyl maleate | 32.67 | 0.3267 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 20,000 mPa.s |
| Appearance: (film/glass) | clear, some specks |
| Flexibility: | elastic, tack |
| Film/water behavior: | resistant |
| Particle size: | 334 nm |
| Solids content: | 55.7% |
| Shear stability: | very good |

EXAMPLE 6

| Raw material type | Raw material | Concentration % by weight | Concentration Kg |
|---|---|---|---|
| Water | | 36.5 | 0.365 |
| Emulsifier | Nonylphenol-10 EO | 1.0 | 0.010 |
| Buffer | $NaHCO_3$ | 0.2 | 0.002 |
| Protective colloid | PEG 12000 | 4.0 | 0.040 |
| Monomer | Vinyl acetate | 18.20 | 0.1820 |
| | Dibutyl maleate | 32.35 | 0.3235 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 28,000 mPa.s |
| Appearance: (film/glass) | clear, few specks |
| Flexibility: | elastic, tack |
| Film/water behavior: | resistant |
| Particle size: | 337 nm |
| Solids content: | 55.4% |
| Shear stability: | very good |

EXAMPLE 7

| Raw material type | Raw material | Concentration % by weight | Concentration Kg |
|---|---|---|---|
| Water | | 36.5 | 0.365 |
| Emulsifier | Nonylphenol-10 EO | 1.0 | 0.010 |
| Buffer | $NaHCO_3$ | 0.2 | 0.002 |
| Foam inhibitor | Silicone oil | 0.2 | 0.002 |
| Protective colloid | PEG 12000 | 3.0 | 0.030 |
| Monomer | Vinyl acetate | 18.48 | 0.1848 |
| | Dibutyl maleate | 32.87 | 0.3287 |

-continued

| | | | |
|---|---|---|---|
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 3,200 mPa.s |
| Appearance: (film/glass) | clear, few specks |
| Flexibility: | elastic, tack |
| Film/water behavior: | resistant |
| Particle size: | 470 nm |
| Solids content: | 54.6% |
| Shear stability: | very good |

EXAMPLE 8

| Raw material type | Raw material | Concentration % by weight | Kg |
|---|---|---|---|
| Water | | 36.5 | 0.365 |
| Emulsifier | Nonylphenol-10 EO | 1.0 | 0.010 |
| Buffer | $NaHCO_3$ | 0.2 | 0.002 |
| Foam inhibitor | Silicone oil | 0.2 | 0.002 |
| Protective colloid | PEG 5000/6000 | 3.0 | 0.030 |
| Monomer | Vinyl acetate | 18.48 | 0.1848 |
| | Dibutyl maleate | 32.87 | 0.3287 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 250 mPa.s |
| Appearance: (film/glass) | clear, many specks |
| Flexibility: | elastic, tack |
| Film/water behavior: | resistant |
| Particle size: | 675 nm |
| Solids content: | 56.6% |
| Shear stability: | very good |

EXAMPLE 9

| Raw material type | Raw material | Concentration % by weight | Kg |
|---|---|---|---|
| Water | | 36.5 | 0.365 |
| Emulsifier | Nonylphenol-10 EO | 0.5 | 0.005 |
| | Nonylphenol-30 EO | 0.5 | 0.005 |
| Buffer | $NaHCO_3$ | 0.2 | 0.002 |
| Foam inhibitor | Silicone oil | 0.2 | 0.002 |
| Protective colloids | PEG 5000/6000 | 3.0 | 0.030 |
| Monomers | Vinyl acetate | 18.48 | 0.1848 |
| | Dibutyl maleate | 32.87 | 0.3287 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 300 mPa.s |
| Appearance: (film/glass) | clear, few specks |
| Flexibility: | elastic, tack |
| Film/water behavior: | resistant |
| Particle size: | 563 nm |
| Solids content: | 52.2% |
| Shear stability: | very good |

EXAMPLE 10

| Raw material type | Raw material | Concentration % by weight | Kg |
|---|---|---|---|
| Water | | 36.5 | 0.365 |
| Emulsifier | Nonylphenol-10 EO-sulfate | 1.0 | 0.0333 |
| Buffer | $NaHCO_3$ | 0.2 | 0.002 |
| Foam inhibitor | Silicone oil | 0.2 | 0.002 |
| Protective colloid | PEG 5000/6000 | 3.0 | 0.030 |
| Monomer | Vinyl acetate | 18.48 | 0.1848 |
| | Dibutyl maleate | 32.87 | 0.3287 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 7,600 mPa.s |
| Appearance: (film/glass) | clear, very few specks |
| Flexibility: | elastic, tack |
| Film/water behavior: | resistant |
| Particle size: | 250 nm |
| Solids content: | 56.0% |
| Shear stability: | poor, skin formation |

EXAMPLE 11

| Raw material type | Raw material | Concentration % by weight | Kg |
|---|---|---|---|
| Water | | 36.5 | 0.365 |
| Emulsifier | Nonylphenol-10 EO sulfate | 1.0 | 0.010 |
| Buffer | $NaHCO_3$ | 0.2 | 0.002 |
| Foam inhibitor | Silicone oil | 0.2 | 0.002 |
| Protective colloid | PEG 5000/6000 | 3.0 | 0.030 |
| Monomer | Vinyl acetate | 18.48 | 0.1848 |
| | Dibutyl maleate | 32.87 | 0.3287 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 250 mPa.s |
| Appearance: (film/glass) | clear, few specks |
| Flexibility: | elastic, tack |
| Film/water behavior: | resistant |
| Particle size: | 385 nm |
| Solids content: | 53.4% |
| Shear stability: | very good |

EXAMPLE 12

| Raw material type | Raw material | Concentration % by weight | Kg |
|---|---|---|---|
| Water | | 36.5 | 0.365 |
| Emulsifier | Nonylphenol-10 EO | 1.0 | 0.010 |
| Buffer | $NaHCO_3$ | 0.2 | 0.002 |
| Foam inhibitor | Silicone oil | 0.2 | 0.002 |
| Protective colloid | PEG 20000 | 3.0 | 0.030 |
| Monomer | Vinyl acetate | 18.48 | 0.1848 |
| | Dibutyl maleate | 32.87 | 0.3287 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 16,000 mPa.s |
| Appearance: (film/glass) | clear, few specks |
| Flexibility: | elastic, tack |
| Film/water behavior: | resistant |

-continued

| | |
|---|---|
| Particle size: | 1,870 nm |
| Solids content: | 51.8% |
| Shear stability: | very good |

EXAMPLE 13

| Raw material type | Raw material | Concentration % by weight | Concentration Kg |
|---|---|---|---|
| Water | | 36.5 | 0.365 |
| Emulsifier | Nonylphenol-10 EO | 1.0 | 0.010 |
| Buffer | $NaHCO_3$ | 0.2 | 0.002 |
| Foam inhibitor | Silicone oil | 0.2 | 0.002 |
| Protective colloid | PEG 50000 | 3.0 | 0.030 |
| Monomer | Vinyl acetate | 18.48 | 0.1848 |
| | Dibutyl maleate | 32.87 | 0.3287 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 10,000 mPa.s |
| Appearance: (film/glass) | clear, few specks |
| Flexibility: | elastic, tack |
| Film/water behavior: | resistant |
| Particle size: | 1,500 nm |
| Solids content: | 53.4% |
| Shear stability: | very good |

EXAMPLE 14

| Raw material type | Raw material | Concentration % by weight | Concentration Kg |
|---|---|---|---|
| Water | | 34.17 | 10.251 |
| Emulsifier | Nonylphenol-10 EO- | 1.0 | 0.999 |
| Buffer | $NaHCO_3$ | 0.2 | 0.060 |
| Foam inhibitor | Silicone oil | 0.2 | 0.060 |
| Protective colloid | PEG 12000 | 3.5 | 1.050 |
| Monomer | Vinyl acetate | 33.56 | 10.068 |
| | Dibutyl maleate | 17.29 | 5.187 |
| Initiator solution | Potassium persulfate | 0.25 | 0.075 |
| | Water | 7.50 | 2.250 |

| | |
|---|---|
| Viscosity: (Brookfield RVT 20° C./20 r.p.m.) | 12,000 mPa.s |
| Appearance: (film/glass) | clear, very few specks |
| Flexibility: | elastic |
| Film/water behavior: | resistant |
| Particle size: | 450 nm |
| Solids content: | 55.8% |

EXAMPLE 15

| Raw material type | Raw material | Concentration % by weight | Concentration Kg |
|---|---|---|---|
| Water | | 42.5 | 0.425 |
| Emulsifier | Nonylphenol-10 EO | 0.5 | 0.005 |
| Buffer | $NaHCO_3$ | 0.2 | 0.002 |
| Protective colloid | PEG 12000 | 5.0 | 0.050 |
| Monomer | Vinyl acetate | 44.05 | 0.4405 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 2,800 mPa.s |
| Appearance: (film/glass) | clear, no specks |
| Flexibility: | brittle, elastic |
| Film/water behavior: | resistant |
| Particle size: | 280 nm |
| Solids content: | 49.8% |
| Shear stability: | very good |

EXAMPLE 16

| Raw material type | Raw material | Concentration % by weight | Concentration Kg |
|---|---|---|---|
| Water | | 42.5 | 0.425 |
| Emulsifier | Nonylphenol-10 EO | 0.5 | 0.005 |
| Buffer | $NaHCO_3$ | 0.2 | 0.002 |
| Protective colloid | PEG 12000 | 7.0 | 0.070 |
| Monomer | Vinyl acetate | 44.05 | 0.4205 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 3,500 mPa.s |
| Appearance: (film/glass) | clear, no specks |
| Flexibility: | elastic |
| Film/water behavior: | resistant |
| Particle size: | 230 nm |
| Solids content: | 49.8% |
| Shear stability: | very good |

EXAMPLE 17

| Raw material type | Raw material | Concentration % by weight | Concentration Kg |
|---|---|---|---|
| Water | | 42.5 | 0.425 |
| Emulsifier | Nonylphenol-10 EO | 0.5 | 0.005 |
| Buffer | $NaHCO_3$ | 0.2 | 0.002 |
| Protective colloid | PEG 12000 | 10.0 | 0.100 |
| Monomer | Vinyl acetate | 39.05 | 0.3905 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 3,800 mPa.s |
| Appearance: (film/glass) | clear, no specks |
| Flexibility: | elastic |
| Film/water behavior: | resistant |
| Particle size: | 220 nm |
| Solids content: | 49.6% |
| Shear stability: | very good |

EXAMPLE 18

| Raw material type | Raw material | Concentration % by weight | Concentration Kg |
|---|---|---|---|
| Water | | 42.5 | 0.425 |
| Emulsifier | Nonylphenol-10 EO | 1.0 | 0.010 |
| Buffer | $NaHCO_3$ | 0.2 | 0.002 |
| Protective colloid | PEG 12000 | 5.0 | 0.050 |
| Monomer | Vinyl acetate | 43.55 | 0.4355 |
| Initiator | Potassium persulfate | 0.25 | 0.0025 |

-continued

| | | | |
|---|---|---|---|
| solution | Water | 7.50 | 0.0750 |

| | |
|---|---|
| Viscosity: (Brookfield RVT 20° C./20 r.p.m.) | 5,500 mPa.s |
| Appearance: (film/glass) | clear, few specks |
| Flexibility: | elastic |
| Film/water behavior: | resistant |
| Particle size: | 210 nm |
| Solids content: | 49.2% |
| Shear stability: | very good |

EXAMPLE 19

| Raw material | | Concentration | |
|---|---|---|---|
| type | Raw material | % by weight | Kg |
| Water | | 42.5 | 0.425 |
| Emulsifier | Nonylphenol-10 EO | 1.0 | 0.010 |
| Buffer | $NaHCO_3$ | 0.2 | 0.002 |
| Protective colloid | PEG 12000 | 7.0 | 0.070 |
| Monomer | Vinyl acetate | 41.55 | 0.4155 |
| Initiator | Potassium persulfate | 0.25 | 0.0025 |
| solution | Water | 7.50 | 0.0750 |

| | |
|---|---|
| Viscosity: (Brookfield RVT 20° C./20 r.p.m.) | 5,200 mPa.s |
| Appearance: (film/glass) | clear, few specks |
| Flexibility: | elastic |
| Film/water behavior: | resistant |
| Particle size: | 240 nm |
| Solids content: | 49.4% |
| Shear stability: | very good |

EXAMPLE 20

| Raw material | | Concentration | |
|---|---|---|---|
| type | Raw material | % by weight | Kg |
| Water | | 42.5 | 0.425 |
| Emulsifier | Nonylphenol-10 EO | 1.0 | 0.010 |
| Buffer | $NaHCO_3$ | 0.2 | 0.002 |
| Protective colloid | PEG 12000 | 10.0 | 0.100 |
| Monomer | Vinyl acetate | 38.55 | 0.3855 |
| Initiator | Potassium persulfate | 0.25 | 0.0025 |
| solution | Water | 7.50 | 0.0750 |

| | |
|---|---|
| Viscosity: (Brookfield RVT 20° C./20 r.p.m.) | 3,400 mPa.s |
| Appearance: (film/glass) | clear, few specks |
| Flexibility: | elastic |
| Film/water behavior: | resistant |
| Particle size: | 200 nm |
| Solids content: | 49.6% |
| Shear stability: | very good |

EXAMPLE 21

| Raw material | | Concentration | |
|---|---|---|---|
| type | Raw material | % by weight | Kg |
| Water | | 42.5 | 0.425 |
| Emulsifier | Nonylphenol-10 EO | 0.25 | 0.0025 |
| Buffer | $NaHCO_3$ | 0.2 | 0.002 |
| Protective | PEG 12000 | 5.0 | 0.050 |

-continued

| | | | |
|---|---|---|---|
| colloid | | | |
| Monomer | Vinyl acetate | 44.3 | 0.443 |
| Initiator | Potassium persulfate | 0.25 | 0.0025 |
| solution | Water | 7.50 | 0.0750 |

| | |
|---|---|
| Viscosity: (Brookfield RVT 20° C./20 r.p.m.) | 550 mPa.s |
| Appearance: (film/glass) | clear, few specks |
| Flexibility: | elastic |
| Film/water behavior: | resistant |
| Particle size: | 200 nm |
| Solids content: | 49.9% |
| Shear stability: | very good |

EXAMPLE 22

| Raw material | | Concentration | |
|---|---|---|---|
| type | Raw material | % by weight | Kg |
| Water | | 42.5 | 0.425 |
| Emulsifier | Nonylphenol-10 EO | 0.25 | 0.0025 |
| Buffer | $NaHCO_3$ | 0.2 | 0.002 |
| Protective colloid | PEG 12000 | 7.0 | 0.070 |
| Monomer | Vinyl acetate | 42.3 | 0.423 |
| Initiator | Potassium persulfate | 0.25 | 0.0025 |
| solution | Water | 7.50 | 0.0075 |

| | |
|---|---|
| Viscosity: (Brookfield RVT 20° C./20 r.p.m.) | 950 mPa.s |
| Appearance: (film/glass) | clear, few specks |
| Flexibility: | elastic |
| Film/water behavior: | resistant |
| Particle size: | 195 nm |
| Solids content: | 50.4% |
| Shear stability: | very good |

EXAMPLE 23

| Raw material | | Concentration | |
|---|---|---|---|
| type | Raw material | % by weight | Kg |
| Water | | 42.5 | 0.425 |
| Emulsifier | Nonylphenol-10 EO | 0.25 | 0.0025 |
| Buffer | $NaHCO_3$ | 0.2 | 0.002 |
| Protective colloid | PEG 12000 | 10.0 | 0.100 |
| Monomer | Vinyl acetate | 39.3 | 0.393 |
| Initiator | Potassium persulfate | 0.25 | 0.0025 |
| solution | Water | 7.50 | 0.0075 |

| | |
|---|---|
| Viscosity: (Brookfield RVT 20° C./20 r.p.m.) | 2,500 mPa.s |
| Appearance: (film/glass) | clear, few specks |
| Flexibility: | elastic |
| Film/water behavior: | resistant |
| Particle size: | 205 nm |
| Solids content: | 50.2% |
| Shear stability: | very good |

COMPARISON EXAMPLE 1

| Raw material | | Concentration | |
|---|---|---|---|
| type | Raw material | % by weight | Kg |
| Water | | 36.5 | 0.365 |

-continued

| | | | |
|---|---|---|---|
| Emulsifier | Nonylphenol-10 EO sulfate | 0.3 | 0.010 |
| Buffer | $NaHCO_3$ | 0.2 | 0.002 |
| Foam inhibitor | Silicone oil | 0.2 | 0.002 |
| Protective colloid | Mowiol 4/88* | 1.95 | 0.0195 |
| | Mowiol 18/88* | 1.00 | 0.0100 |
| Monomer | Vinyl acetate | 18.834 | 0.18834 |
| | Dibutyl maleate | 33.314 | 0.33314 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 20,000 mPa.s |
| Appearance: (film/glass) | clear |
| Flexibility: | elastic |
| Film/water behavior: | resistant |
| Particle size: | 1020 nm |
| Solids content: | 55.4% |
| Shear stability: | poor |

*Polyvinyl alcohol, products of HOECHST AG

COMPARISON EXAMPLE 2 AND 2.1

| Raw material type | Raw material | Concentration % by weight | Kg |
|---|---|---|---|
| Water | | 35.8 | 0.358 |
| Emulsifier | Nonylphenol-10 E0 sulfate | 0.3 | 0.010 |
| Buffer | $NaHCO_3$ | 0.2 | 0.002 |
| Foam inhibitor | Silicone oil | 0.1 | 0.001 |
| Protective colloid | Mowiol 4/88* | 2.95 | 0.0295 |
| Monomer | Vinyl acetate | 18.834 | 0.18834 |
| | Dibutyl maleate | 33.314 | 0.33314 |
| Initiator solution | Potassium persulfate | 0.3 | 0.003 |
| | Water | 7.5 | 0.0750 |

| | |
|---|---|
| Viscosity: (Brookfield RVT 20° C./20 r.p.m.) | 16,000 mPa.s |
| Appearance: (film/glass) | clear, very few specks |
| Flexibility: | elastic |
| Film/water behavior: | resistant |
| Particle size: | 920 nm |
| Solids content: | 56.1% |

Polyvinyl alcohol, product of HOECHST AG

In Comparison Example 2.1, 3% by weight PEG12000 was subsequently added to the emulsion polymer

COMPARISON EXAMPLE 3

| Raw material type | Raw material | Concentration % by weight | Kg |
|---|---|---|---|
| Water | | 36.5 | 0.365 |
| Emulsifier | Nonylphenol-10 E0 sulfate | 0.3 | 0.010 |
| Buffer | $NaHCO_3$ | 0.2 | 0.002 |
| Foam inhibitor | Silicone oil | 0.2 | 0.002 |
| Protective colloid | Mowiol 4/88* | 1.95 | 0.0195 |
| | Mowiol 18/88* | 1.00 | 0.0100 |
| Monomer | Vinyl acetate | 21.50 | 0.2150 |
| | Dibutyl maleate | 30.67 | 0.3067 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 23,000 mPa.s |
| Appearance: (film/glass) | clear |
| Flexibility: | elastic |
| Film/water behavior: | resistant |
| Particle size: | 808 nm |
| Solids content: | 55.8% |
| Shear stability: | poor |

*Polyvinyl alcohol, products of HOECHST AG

COMPARISON EXAMPLE 4

| Raw material type | Raw material | Concentration % by weight | Kg |
|---|---|---|---|
| Water | | 36.5 | 0.365 |
| Emulsifier | Nonylphenol-10 EO sulfate | 0.3 | 0.010 |
| Buffer | $NaHCO_3$ | 0.2 | 0.002 |
| Foam inhibitor | Silicone oil | 0.2 | 0.002 |
| Protective colloid | Mowiol 4/88* | 1.95 | 0.0195 |
| | Mowiol 18/88* | 1.00 | 0.0100 |
| Monomer | Vinyl acetate | 26.075 | 0.26075 |
| | Dibutyl maleate | 26.075 | 0.26075 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 27,500 mPa.s |
| Appearance: (film/glass) | clear |
| Flexibility: | elastic |
| Film/water behavior: | resistant |
| Particle size: | 627 nm |
| Solids content: | 55.7% |
| Shear stability: | poor |

Polyvinyl alcohol, products of HOECHST AG

COMPARISON EXAMPLE 5

| Raw material type | Raw material | Concentration % by weight | Kg |
|---|---|---|---|
| Water | | 35.8 | 0.358 |
| Emulsifier | Nonylphenol-10 EO sulfate | 0.3 | 0.010 |
| Buffer | $NaHCO_3$ | 0.2 | 0.002 |
| Foam inhibitor | Silicone oil | 0.1 | 0.001 |
| Protective colloid | Mowiol 18/88* | 2.95 | 0.0295 |
| Monomer | Vinyl acetate | 21.50 | 0.2150 |
| | Dibutyl maleate | 30.67 | 0.3067 |
| Initiator solution | Potassium persulfate | 0.30 | 0.0030 |
| | Water | 7.50 | 0.0750 |

| | |
|---|---|
| Viscosity: (Brookfield RVT 20° C./20 r.p.m.) | 155,000 mPa.s |
| Appearance: (film/glass) | clear |
| Flexibility: | soft - elastic |
| Film/water behavior: | resistant |
| Particle size: | 680 nm |
| Solids content: | 55.9% |
| Shear stability: | poor |

*Polyvinyl alcohol, products of HOECHST AG

COMPARISON EXAMPLE 6 AND 6.1

| Raw material type | Raw material | Concentration % by weight | Kg |
|---|---|---|---|
| Water | | 35.35 | 0.3535 |
| Emulsifier | Nonylphenol-10 EO sulfate | 0.50 | 0.0165 |

-continued

| | | | |
|---|---|---|---|
| Buffer | $NaHCO_3$ | 0.20 | 0.0020 |
| Foam inhibitor | Silicone oil | 0.10 | 0.0010 |
| Protective colloid | Mowiol 18/88* | 6.00 | 0.0600 |
| Monomer | Vinyl acetate | 32.30 | 0.3230 |
| | Dibutyl maleate | 16.65 | 0.1665 |
| Initiator solution | Potassium persulfate | 0.25 | 0.0025 |
| | Water | 7.50 | 0.0750 |

| | |
|---|---|
| Viscosity: (Brookfield RVT 20° C./20 r.p.m.) | 162,000 mPa.s |
| Appearance: (film/glass) | clear, few specks |
| Flexibility: | elastic |
| Film/water behavior: | resistant |
| Particle size: | — |
| Solids content: | 53.8% |

*Polyvinyl alcohol, products of HOECHST AG

Comparison Example 6.1 contains 3.5% by weight subsequently added PEG 12000

COMPARISON EXAMPLE 7 AND 7.1

| Raw material type | Raw material | Concentration % by weight | Kg |
|---|---|---|---|
| Water | | 35.3 | 10.500 |
| Emulsifier | Nonylphenol-10 EO sulfate | 0.5 | 0.495 |
| Buffer | $NaHCO_3$ | 0.2 | 0.060 |
| Foam inhibitor | Silicone oil | 0.1 | 0.030 |
| Protective Colliod | CMC/A 400 P* | 2.5 | 0.75 |
| Monomer | Vinyl acetate | 34.5 | 10.350 |
| | Dibutyl maleate | 18.0 | 5.400 |
| Initiator solution | Potassium persulfate | 0.25 | 0.075 |
| | Water | 7.50 | 2.250 |

| | |
|---|---|
| Viscosity: (Brookfield RVT 20° C./20 r.p.m.) | 10,000 mPa.s |
| Appearance: (film/glass) | clear, few specks |
| Flexibility: | elastic |
| Film/water behavior: | redispersible |
| Particle size: | 930 nm |
| Solids content: | 56.1% |

*Polyvinyl alcohol, product of HOECHST AG

Comparision Example 7.1 contains 3.5% by weight subsequently added PEG 12000

COMPARISON EXAMPLE 8 AND 8.1

The commercially available dispersion "Mowilith D 50" (a product of Hoechst AG) is used as Comparison Example 8.

In comparison Example 8.1, 5.0% by weight PEG 12000 is added to this dispersion. The commercially available dispersion contains a vinyl acetate polymer for a solids concentration of 50% by weight (protective colloid: approx. 3.0% by weight polyvinyl alcohol).

COMPARISON EXAMPLE 9 AND 9.1

| Raw material type | Raw material | Concentration % by weight | Kg |
|---|---|---|---|
| Water | | 36.43 | 10.239 |
| Emulsifier | Nonylphenol-10 EO sulfate | 1.0 | 0.999 |
| Buffer | $NaHCO_3$ | 0.2 | 0.060 |
| Foam inhibitor | Silicone oil | 0.1 | 0.030 |

-continued

| | | | |
|---|---|---|---|
| Protective colloid | CMC/A 400 P* | 5.0 | 1.500 |
| Monomer | Vinyl acetate | 49.50 | 14.850 |
| Initiator solution | Potassium persulfate | 0.25 | 0.075 |
| | Water | 7.50 | 2.250 |

| | |
|---|---|
| Viscosity: (Brookfield RVT 20° C./20 r.p.m.) | 37,500 mPa.s |
| Appearance: (film/glass) | slightly cloudy, few specks |
| Flexibility: | brittle |
| Film/water behavior: | redispersible |
| Particle size: | 1450 nm |
| Solids content: | 56.4% |

*Polyvinyl alcohol, product of HOECHST AG

Comparison Example 9.1 contains 5.0% by weight subsequently added PEG 12000

Feel assessment

The dispersions of Examples 1 to 9 and 11 to 15 and of Comparison Examples 1, 2, 2.1 and 6 to 9.1 are applied to cotton fabric using a laboratory padder and dried on a tenter frame for 60 seconds at 130° C. The liquor concentrations are adjusted to give a solids covering of 4%. Feel was then assessed on the following scale:

Feel:

1=very hard

8=very soft

Volume:

1=very flat

5=very full

The feel marks awarded to the samples tested are shown in the following Table. The shear stability of the materials of Comparison Examples 3 to 5 is poor.

TABLE

| | Feel assessment feel | volume |
|---|---|---|
| Example | | |
| 1 | 8 | 5 |
| 2 | 8 | 5 |
| 3 | 8 | 5 |
| 4 | 8 | 5 |
| 5 | 8 | 5 |
| 6 | 8 | 5 |
| 7 | 8 | 5 |
| 8 | 8 | 5 |
| 9 | 8 | 5 |
| 10 | 8 | 5 |
| 11 | 8 | 5 |
| 12 | 8 | 5 |
| 13 | 8 | 5 |
| 14 | 5 | 3 |
| 15 | 5 | 1 |
| Comparison Example 1 | 6 | 5 |
| Comparison Example 2 | 6 | 5 |
| Comparison Example 2.1 | 6–7 | 5 |
| Comparison Example 6 | 2 | 3 |
| Comparison Example 6.1 | 3 | 3 |
| Comparison Example 7 | 2–3 | 3 |
| Comparison Example 7.1 | 3–4 | 3 |
| Comparison Example 8 | 1 | 1 |
| Comparison Example 8.1 | 1–2 | 1 |
| Comparison Example 9 | 2 | 1 |
| Comparison Example 9.1 | 3 | 1 |

We claim:

1. In a method of treating textiles with an aqueous emulsion polymer, the improvement wherein the textile is treated with an aqueous emulsion comprising:

(a) from about 40 to about 60% by weight of either a polymer of vinyl acetate, a copolymer of vinyl acetate and dibutyl maleate, or a mixture of the foregoing; and (b) from about 2 to about 10% by weight of a polyethylene glycol having a molecular weight of from about 3,000 to about 50,000;

wherein the above percentages by weight are based on the weight of the aqueous emulsion, and wherein the aqueous emulsion is employed in a quantity sufficient to impart a soft and full feel to the textile.

2. The method of claim 1 wherein the textile is in sheet form.

3. The method of claim 1 wherein the average molecular weight of the polyethylene glycol is from about 8,000 to about 25,000.

4. The method of claim 1 wherein at least part of the polyethylene glycol was present during the preparation of the aqueous emulsion.

5. The method of claim 1 wherein from about 3 to about 10% of component (b) is present in the aqueous emulsion.

6. The method of claim 1 wherein a component (a) is a copolymer of vinyl acetate and dibutyl maleate having a dibutyl maleate content of from about 5 to about 45 mole %, based on the total of vinyl acetate and dibutyl maleate.

7. The method of claim 1 wherein the aqueous emulsion also contains from about 0.5 to about 5% of an emulsifier.

8. The method of claim 7 wherein from about 0.5 to about 3% of the emulsifier is present in the aqueous emulsion.

9. The method of claim 7 wherein from about 0.5 to about 2% of the emulsifier is present in the aqueous emulsion.

10. The method of claim 7 wherein the emulsifier is a nonionic surfactant.

11. The method of claim 10 wherein the nonionic surfactant is a polyethylene oxide adduct with a hydrocarbon compound containing a reactive hydrogen atom.

12. The method of claim 10 wherein the nonionic surfactant is an alkylphenol ethylene oxide adduct.

13. The method of claim 10 wherein the nonionic surfactant is nonylphenol.10ethylene oxide units.

* * * * *